United States Patent [19]

Bracy

[11] Patent Number: 4,799,665

[45] Date of Patent: Jan. 24, 1989

[54] SANDBOX AND SWIMMINGPOOL PLAYSET

[76] Inventor: Julie A. Bracy, 3871 S. Fraser, Aurora, Colo. 80014

[21] Appl. No.: 887,426

[22] Filed: Jul. 21, 1986

[51] Int. Cl.[4] ..... A63B 17/04

[52] U.S. Cl. ..... 272/1 R; 272/1 A; 272/1 B; 272/113

[58] Field of Search ..... 272/1 A, 1 R, 56.5 SS, 272/85, 109, 113, 1 B; D21/252

[56] References Cited

U.S. PATENT DOCUMENTS

| | | | |
|---|---|---|---|
| D. 259,356 | 5/1981 | Ferretti | D21/252 |
| 1,185,176 | 5/1916 | Cardozo | 272/113 X |
| 1,765,361 | 6/1930 | Berman | 272/113 |
| 2,423,955 | 7/1947 | Widener | 272/1 R |
| 2,483,789 | 10/1949 | Smith et al. | 272/1 A |
| 2,673,086 | 3/1954 | Brown, Sr. | 272/1 R |
| 3,006,705 | 10/1961 | Williams et al. | 272/1 A |
| 3,295,252 | 1/1967 | Willete | 272/1 R |
| 3,339,213 | 9/1967 | Spencer | 272/1 A |
| 3,454,272 | 7/1969 | Elkington et al. | 272/1 A |
| 3,823,426 | 7/1974 | Mitchko | 4/172 |
| 3,881,723 | 5/1975 | Boynton | 272/1 A |
| 4,045,019 | 8/1977 | Wape | 272/1 A |
| 4,343,464 | 8/1982 | Dose | 272/56.5 R |
| 4,515,360 | 5/1985 | Mariol | 272/1 A |
| 4,642,822 | 2/1987 | Tvengsburg | 272/1 A |

OTHER PUBLICATIONS

Catalogue from *Coleco Industries Inc.*, Hartford, Conn., dated Aug. 30, 1966.

*Primary Examiner*—Richard J. Johnson
*Assistant Examiner*—Samuel Rimell
*Attorney, Agent, or Firm*—John E. Reilly

[57] ABSTRACT

A playset which includes a swimming pool, sandbox, four seats, ladder, chinup bar and a slide. The four seats, which are easily removed from the sandbox, may be used as toys for the sandbox or swimming pool. When the ladder and the chinup bar are attached to the sandbox, they may be used to climb on. The ladder is also used to support the slide. When the swimming pool is not used for water play, it can be turned upside down and placed on top of the ladder and chinup bar. This would provide shade over the sandbox. When storage or protection of sand is needed, the ladder, chinup bar, seats, and slide can be placed inside of the sandbox and the swimming pool can be used as a cover.

3 Claims, 2 Drawing Sheets

SANDBOX AND SWIMMINGPOOL PLAYSET

BACKGROUND OF THE INVENTION

The invention relates to sandboxes, particularly to sandboxes with covers.

A few sandboxes with covers provide some use out of the cover but do not serve as a practical piece of the set.

Many sandboxes with covers may be used for swimming or used for playing in the sand. You would need two separate items in this case. This would be a problem if only a small area for play or storage is available.

Therefore it is important to provide a playset that provides both options for playing in the sand and water, and utilizing the space in the best possible way.

SUMMARY OF THE INVENTION

It is therefore the primary object of the present invention to provide a sandbox with a cover that also serves as a swimming pool.

Another object is to provide an easy to assemble play structure which may be used for exercise and creative play while also utilizing space.

DETAILED DESCRIPTION OF THE PREFERRED EMBODIMENTS

Figure 1:
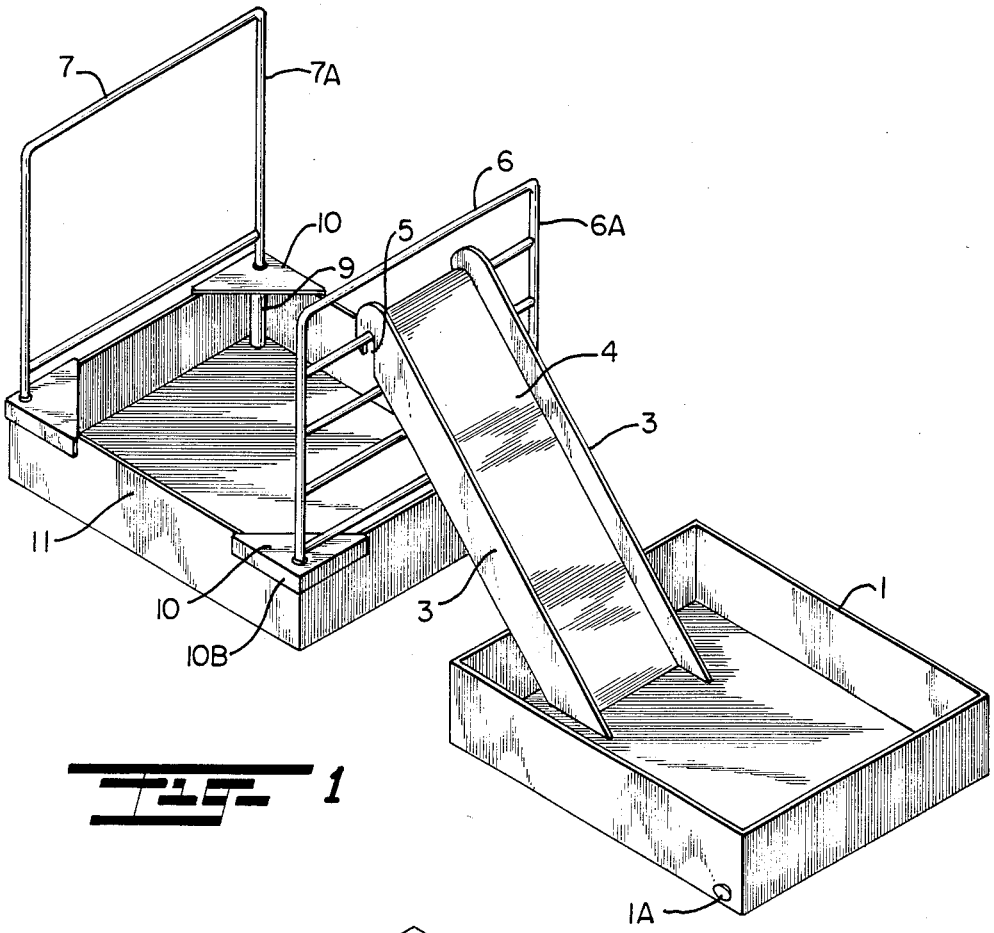
FIG. 1 is a perspective view of the preferred form of invention after complete assembly.
Figure 2:
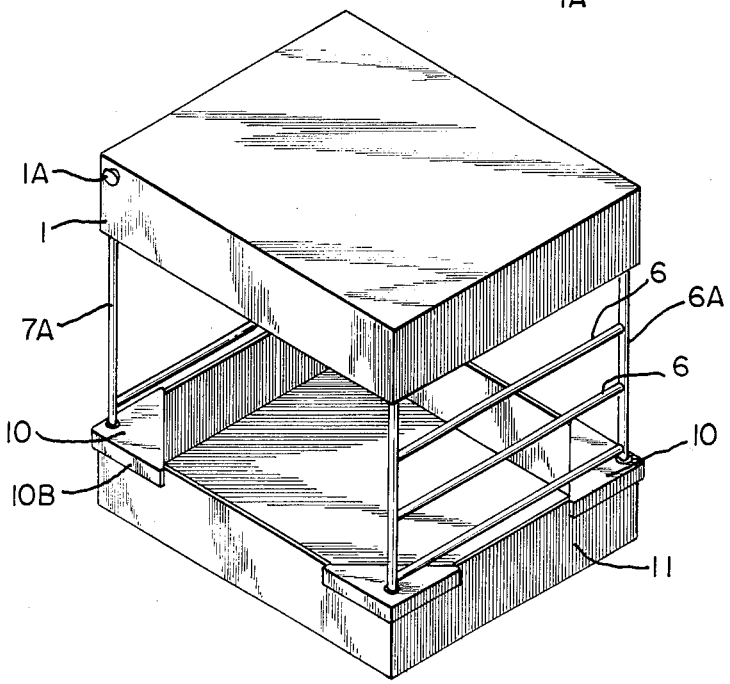
FIG. 2 is a perspective view of the preferred form of invention in a closed position.

Referring to FIG. 2, there is illustrated a square base member forming a part of an open-topped container 11 for sand and a square base member forming a part of an open-topped container 1 for water. The container 1 is slightly larger than the container 11 so that when the container 1 is not filled with water, it may be turned upside down or inverted and place over the container 11 for the sand, as shown in FIG. 1. This will afford protection for the sand and enable storage of the entire playset.

FIG. 1 is a perspective view of the playset completely assembled. The first pieces to assemble are four corner seats 10. These are attached to the four corners of the sand container by means of two depending flanges 10B of each seat 10. The depending flanges 10B are located on the back sides of the triangular shaped seats 10. These slip over the side corners of the sand container 11. See FIGS. 1 and 2 for illustration of the seats.

The seats 10 also have a hole 10A which is located in the back corner of the top. The purpose of the hole 10A is to allow the legs of the ladder 6A and the legs of the chinup bar 7A to slip through. This is necessary for complete assembly of the play structure.

Figure 4:
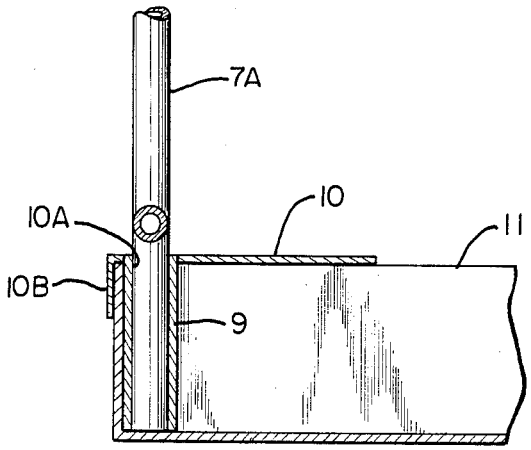
FIG. 4 is an enlarged sectional view showing one corner of a sand container in accordance with the present invention.
Figure 5:
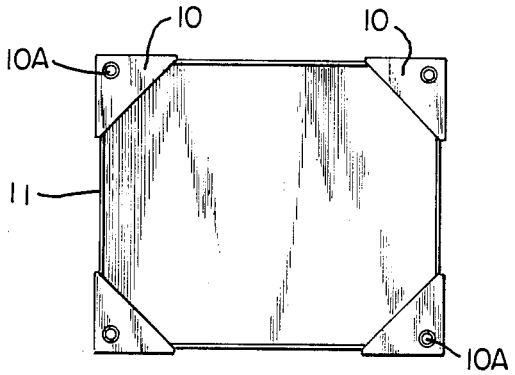
FIG. 5 is a cross-sectional view taken about lines 5—5 of FIG. 3.
Figure 6:
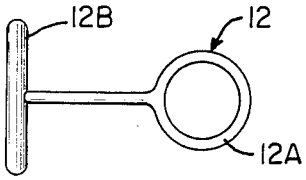
FIG. 6 is a side view of a seal employed as part of a drain plug.
Figure 7:
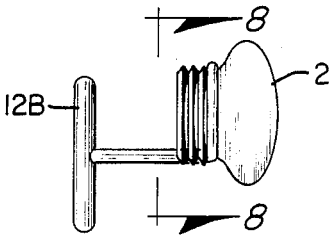
FIG. 7 is a view of the seal of FIG. 6 and drain plug in assembled form.
Figure 8:
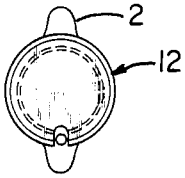
FIG. 8 is an end view of the drain plug as illustrated in FIGS. 7 and 9.
Figure 9:
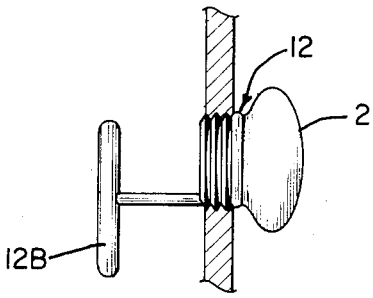
FIG. 9 is a view partially in section of the assembled seal and drain plug attached to a drain opening.

After the four seats 10 are in place, the ladder 6 and the chinup bar 7 may be attached to the sand container 11. FIG. 4 shows an enlarged illustration of the seats and means to attach ladder 6 and chinup bar 7, the ladder 6 being shown.

In FIG. 4 there is a cylinder shaped bracket 9. This is located in each of the inside corners of the sand container 11. The diameter of each hole 10A is slightly larger than the diameter of the legs of the ladder 6A and the legs of the chinup bar 7A. This allows the legs to be inserted easily. The brackets 9 are the same depth as the sand container 11 which is approximately one foot. This gives firm support for the ladder 6 and the chinup bar 7. FIG. 1 and FIG. 2 are illustrations of ladder and chinup bar.

Figure 3:
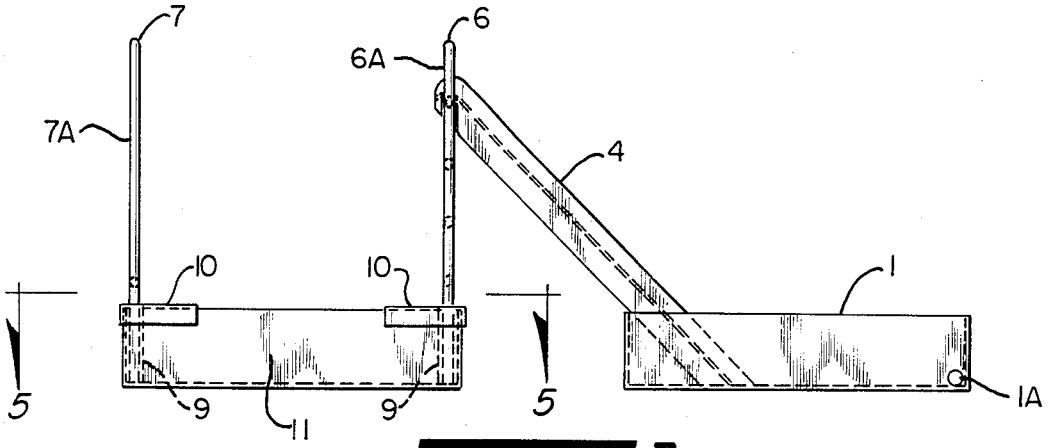
FIG. 3 is a front view in elevation of the preferred form of invention.

Means to attach the slide 4 to the ladder 6 is a U shaped angled groove 5 on each side of the slide. This is located near the top of the slide 4 and underneath each rail 3. The diameter of the groove is only slightly larger than the step on the ladder 6. This allows the groove 5 to slip over the step easily. The slide 4 is secured in place when the bottom of the slide 4 is touching the ground. See FIG. 3 for illustration of the slide.

There are two side rails 3 on each side of the main base of the slide 4. These serve as hand grips while sliding and to protect anyone from sliding off the sides.

The container for water 1 may be placed under the slide 4 for a smooth surface to slide into or it can also serve as a shade cover. This is done by placing it upside down over the top of the ladder 6 and chinup bar 7. See FIG. 2 for an illustration of water container 1 being used as a shade cover.

The container for water 1 has a drain 1A which is located in one lower corner. The drain has a plug 2 which unscrews for easy drainage. There is a seal 12 which is a round ring 12A with a T shaped tail 12B. The tail 12B slips through the drain 1A in the water container 1 and the round ring 12A slips over the threads of the drain plug 2. This will help to keep drain plug 2 from getting lost.

What is claimed is:

1. A playset apparatus comprising:

a first open-topped container, adapted for use as a sandbox and having a bottom and sidewalls;

a second open-topped container, adapted for use as a wading pool and having a bottom and sidewalls, said second container being correspondingly shaped but slighly larger than said first container such that said second container can be inverted and telescoped over said first container; and a pair of removable upstanding support means extending along opposed sidewalls of said first container, said first container including a plurality of socket means secured to the sidewalls thereof, the ends of said upstanding support means being inserted in and supported by said socket means, said upstanding support means being adapted to support said second container in inverted upwardly spaced disposition over said first container.

2. The apparatus of claim 1, further including a seat means, and wherein one of said upstanding support means comprises a ladder.

3. The apparatus of claim 2 further comprising a slide having a sloped planar member and side rails mounted generally perpendicular to said sloped planar member, said side rails terminating in a lower generally horizontal edge for resting on said bottom of said second container adjacent to said sandbox, and upper portions of said rails having vertical slots for receiving a rung of said ladder to hold said slide attached to said ladder.

* * * * *